United States Patent [19]

Duret

[11] Patent Number: 4,796,594

[45] Date of Patent: Jan. 10, 1989

[54] DEVICE AND METHOD FOR INJECTING FUEL INTO AN ENGINE, ASSISTED BY COMPRESSED AIR OR GAS

[76] Inventor: Pierre Duret, 124, boulevard Saint Germain, 75006 Paris, France

[21] Appl. No.: 71,357

[22] Filed: Jul. 9, 1987

Related U.S. Application Data

[63] Continuation of Ser. No. 814,767, Dec. 30, 1985.

[30] Foreign Application Priority Data

Dec. 28, 1984 [FR] France ..... 84 20059

[51] Int. Cl.[4] ..... F02M 25/00

[52] U.S. Cl. ..... 123/531; 123/585; 123/568

[58] Field of Search ..... 123/531, 532, 534, 568, 123/533, 58 J, 65 PE, 65 P, 65 EM, 463, 73 B, 73 C

[56] References Cited

U.S. PATENT DOCUMENTS

| | | | |
|---|---|---|---|
| 1,551,731 | 9/1925 | Charter | 123/532 |
| 3,894,520 | 7/1975 | Clawson | 123/531 |
| 3,996,906 | 12/1976 | Bubniak et al. | 123/531 |
| 4,033,302 | 7/1977 | Jarnuszkiewicz | 123/534 |
| 4,361,126 | 11/1982 | Knapp et al. | 123/585 |
| 4,453,502 | 6/1984 | Reslar, Jr. | 123/568 |
| 4,516,551 | 5/1985 | Urujhidani | 123/568 |

*Primary Examiner*—Raymond Nelli

*Attorney, Agent, or Firm*—Antonelli, Terry & Wands

[57] ABSTRACT

A device and method are provided for the pneumatic injection of fuel into an engine. The device comprises at least one auxiliary duct having two ends one of which is connected to an exhaust pipe and the other to an injection member.

4 Claims, 4 Drawing Sheets

DEVICE AND METHOD FOR INJECTING FUEL INTO AN ENGINE, ASSISTED BY COMPRESSED AIR OR GAS

This is a continuation of application Ser. No. 814,767, filed Dec. 30, 1985.

BACKGROUND OF THE INVENTION

The present invention relates to a device and method for allowing and/or improving the injection of fuel assisted by compressed air or gas, or pneumatic injection, into an internal combustion engine and is applicable to a four or two stroke engine and more particularly to an internal combustion engine with air scavenging.

In the particular case of a two stroke engine with crank case scavenging during a considerable part of the air and fuel intake cycle, the transfer and exhaust ports are simultaneously opened and a part of the air-fuel mixture admitted escapes to the atmosphere before the exhaust ports are closed, thereby resulting in a considerable reduction in an operating efficiency of the internal combustion engine and considerable discharge of pollutants.

To avoid the disadvantages encountered in the prior art, French Pat. No. FR 490.166 proposes a scavenging of the cylinder solely with air coming from the pump crank case, with another part of the air from the pump crank case being fed at near maximum pressure reached in this housing, into a sealed chamber which serves as compressed air source for supplying the pneumatic fuel injection device.

It has been discovered that such a device operated better when it was fed with compressed air at a pressure higher than that existing in the pump crank case.

The prior art may also be illustrated by, for example British Pat. No. GB-A-572.080, German Pat. No DE-C-833.855, U.S. Pat. No. 3,190,270, and French Pat. No. FR-A-2 292 111.

The device of the invention uses the pressure wave effect reigning in the exhaust pipes for enhancing the pneumatic injection. The result is a better quality of pneumatic injection, an increased filling of the engine with air, an increase in the amount of residual combusted gases resulting in a reduction of Nox discharges, partial recovery of the fuel short circuited to the exhaust and a possible reduction of noise due to the exhaust pressure wave effects.

Thus, the present invention relates to an internal combustion engine comprising a means for pneumatically injecting fuel and an system for an internal combustion engine. In accordance with the present invention, the internal combustion engine includes an auxiliary duct having a first end or opening which is connected to an exhaust pipe of the exhaust system and a second end or opening connected to the injection means.

The internal combustion engine includes a pump crankcase, a chamber connecting the pump crankcase to the fuel injection means, which chamber forms an injection chamber, and an auxiliary duct connecting the exhaust pipe of the exhaust system to the injection chamber, which injection chamber may include an obstruction means such as, for example, a stop or check valve, with the obstruction means being located prior to a connection of the auxiliary duct to the injection chamber.

The auxiliary duct may include an obstruction member such as, for example, a stop or check valve adapted to intermittently open under an effect of a mechanical means such as, for example, a cam, or by pneumatic control or electromagnetic control.

It is also possible in accordance with the present invention for the auxiliary duct to include a third aperture opening into a gas source and an obstruction means placed in the aperture, with the obstruction means taking the form of a stop or check valve. Preferably, an end of the auxiliary duct connected to the exhaust pipe is positioned in the exhaust pipe at a location where the pressure wave is maximum, and has a convergent shape with a cross section decreasing from the exhaust pipe toward the auxiliary duct.

The present invention may be applied to an engine comprising at least two cylinders each of which comprises an exhaust pipe and an injection member. In this case, the engine may also comprise at least one crossed auxiliary duct connecting said exhaust pipe of one of the cylinders to the injection member of the other cylinder.

The present invention may be applied to an engine comprising at least two cylinders each of which comprises an exhaust pipe, an injection member and an injection chamber connected to said injection member of one the cylinders, or cylinder considered. In this case, the engine may also comprise at least one crossed auxiliary duct connecting said injection chamber to the exhaust pipe of the other cylinder.

If it is the cylinder considered which comprises a pump crank case, the engine may comprise at least one injection chamber connecting the pump crank case to the injection member of the cylinder considered and the crossed auxiliary duct may connect the exhaust pipe of the other cylinder to the injection chamber of the cylinder considered.

The present invention may also be applied to an engine comprising at least two cylinders, with each of the cylinders having an exhaust pipe and an injection means. In this case, the engine may also comprise at least two auxiliary crossed ducts, each of them connecting the exhaust pipe of one of the cylinders to the injection means of the other cylinder.

The present invention may also be applied to an engine comprising several cylinders at least one of which comprising an exhaust pipe and another comprising a pneumatic injection member. In this case an auxiliary duct may connect the exhaust pipe to the pneumatic injection member.

If this engine is an engine whose cylinders comprise a pump crank case, it may also comprise at least two injection chambers, each of them connecting the pump crank case of one of the cylinders, or cylinder considered, to the injection means of the same cylinder and each of the auxiliary ducts may connect the exhaust pipe of the other cylinder to the injection chamber connected to the injection means of the cylinder considered.

The present invention may be applied to an engine comprising at least two cylinders, one at least of which comprises a pump crank case. In this case, the engine may comprise at least one so called cross injection chamber connecting said pump crank case to the injection member of the other cylinder.

Still within the scope of the present invention, this other cylinder may comprise an exhaust pipe and an auxiliary duct which connects the exhaust pipe of this other cylinder to the crossed injection chamber connected to the injection member of this same cylinder.

The present invention may be applied to an engine having at least two cylinders each equipped with a pump crank case. In this case the engine may comprise at least two crossed injection chambers, each of them connecting the pump crank case of one the cylinders to the injection member of the other cylinder.

Still within the scope of the present invention, the engine may comprise at least two auxiliary ducts, each of them connecting the exhaust pipe of one of the cylinders or cylinder considered, to the injection chamber connected to the injection means of this same cylinder.

Thus it is apparent that, in the case of multi-cylinders, the present invention provides numerous combinations of communications between the exhaust pipes of the different cylinders and the injection means, as well as between the pump crank cases and the injection members.

Similar combinations are also possible within the scope of the present invention, more especially when the engine comprises an exhaust manifold or if it comprises a common injection chamber communicating with several pump crank cases and at least one injection member. For example, still within the scope of the present invention, an auxiliary duct may be connected to an injection means via the common injection chamber, or not.

The injection chamber may be formed by a duct, this is moreover the preferred embodiment.

The present invention also provides a method for providing fuel injection in an internal combustion engine equipped with a pneumatic injection means and an exhaust pipe wherein a communication is formed between the exaust duct and the injection means. This method may be applied to an engine comprising a pump housing or crank case. In this embodiment part of the compressed gases coming from the pump housing is directed towards the injection means and is combined with the gases coming from the communication between the exhaust and the injection means.

Still within the scope of the present invention, the communication may be placed in relation with a gas source via an obstruction means such as a stop valve or non return valve.

When the engine to which the method of the invention applies comprises at least two cylinders each of which comprises an exhaust pipe and an injection means, at least one so called crossed communication may be provided connecting the exhaust pipe of one of the cylinders or cylinder considered to the injection means of the other cylinder.

If the method of the invention is applied to an engine in which of said cylinders comprises a pump crank case and a transfer duct, a part of the compressed gases coming from the pump crank case of the cylinder considered may be directed towards the injection member of the same cylinder and be combined with the gases coming from the communication between the exhaust pipe of the other cylinder with the injection member of the cylinder considered.

If the method of the invention is applied to an engine comprising at least two cylinders, at least one of these cylinders comprising a pump crank case, a part of the compressed gases coming from the pump crank cases may be directed towards the injection member of another cylinder.

When the method of the invention is applied to an engine in which each cylinder comprises an exhaust pipe, the communication may connect the exhaust pipe of this other cylinder to the injection means of this same cylinder and at least a part of the compressed gases coming from the pump crank case may be directed towards the injection member and be combined with the gases coming from the communication.

The above objects, features, and advantages of the present invention will become more apparent from the following description when taken in connection with the accompanying drawing which shows, for the purpose of illustration only, several embodiments in accordance with the present invention.

DETAILED DESCRIPTION

Figure 1:
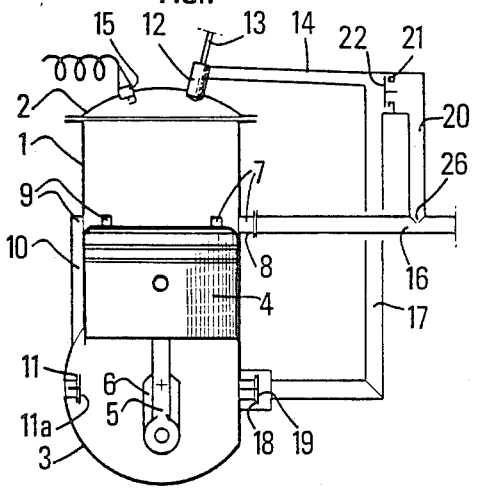
FIG. 1 is a schematic view of a two stroke engine with scavenging by the crank case, with a fuel injection assisted by compressed air or gas supplied from a tube or sealed chamber fed with air by the crank case and provided with a device constructed in accordance with the present invention.

Referring now to the drawings wherein like reference numerals are used throughout the various views to designate like parts and, more particularly, to FIG. 1, according to this figure, a cylinder 1, closed at its upper end by a cylinder head 2, communicates at a lower end thereof with a sealed crank case 3, with a piston 4, connected to a crankshaft by a connecting rod 5 being displacably mounted in the cylinder 1. Ports 7 are formed in the wall of the cylinder 1 and communicate with an exhaust pipe 8, with ports 9, formed in the cylinder wall 1, allowing air to be introduced into the cylinder. The ports 9 communicate with a sealed crank case 3 through a transfer channel 10. The ports 7 and 9 respectively forming exhaust and intake ports are arranged and dimensioned in a conventional manner for ensuring an efficient filling of the cylinder as well as a complete discharge or exhausting of combusted gases. The crank case 3 is provided with an air intake orifice 11 provided with a valve **11*a*, for examle, a blade valve. The orifice 11 is connected to an air filter not shown and the valve 11*a* is open and permits air to penetrate into the crank case 3 when the pressure in the crank case is lower than a pressure of the feed air. The valve 11*a* closes as soon as the pressure in the crank case 3** is higher than the pressure of the feed air.

The crank case 3 communicates with a sealed chamber 17 having a volume V through an orifice 18 provided with a valve 19 such as, for example, a blade valve.

The valve 19, in an open position, communicates the chamber 17 with a remaining portion of the crank case 3 when the pressure in the chamber 17 is less than a pressure existing in the remaining portion of the crank case 3. When the pressure in the chamber 17 is greater than the pressure existing in the remaining portion of the crank case 3, the valve 19 closes thereby isolating the chamber 17 from the remaining portion of the crank case 3.

A pneumatic fuel injection member at 12, allows a pressurized carburetted air mixture to be fed into cylinder 1. For this purpose, the member 12 is connected to a fuel supply duct 13 and to a compressed air and/or gas supply duct 14 which communicates with chamber 17.

Cylinder head 2 also comprises a spark plug 15 whose electric supply circuit has not been shown.

The device of the invention comprises an auxiliary duct or tube 20 connecting the exhaust pipe 16 with the sealed chamber 17, with communication between the tube 20 and the sealed chamber 17 taking place through an orifice 21 provided with a valve 22 such as, for example, a blade valve.

When the pressure in the tube 20 is greater than the pressure existing in the sealed chamber 17, the valve 22 opens and places the tube 20 in communication with the sealed chamber 17. When the pressure in the sealed chamber 17 is higher than the pressure existing in the tube 20, the valve 22 closes thereby isolating the sealed chamber 17 from the tube 20.

The operation of the engine is described here after with reference to FIGS. 2 to 6.

Figure 2:
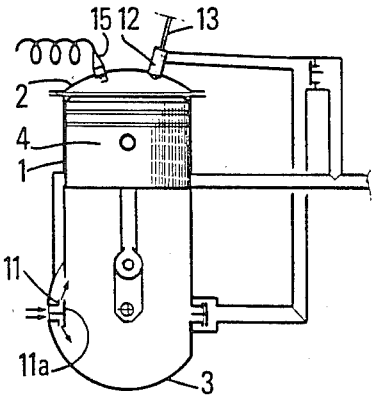
FIGS. 2–6 are schematic views respectively depicting an operation of the engine of FIG. 1.

In FIG. 2, the piston 4 has reached the top dead center by moving towards the cylinder head 2 and the intake and exhaust ports 9, 7 are closed by piston 4. The valve 11*a* is in an open positioned thereby permitting air to penetrate into the crank case 3 through orifice 11. In FIG. 2, the valve 19 and valve 22 19 22 are closed.

Figure 3:
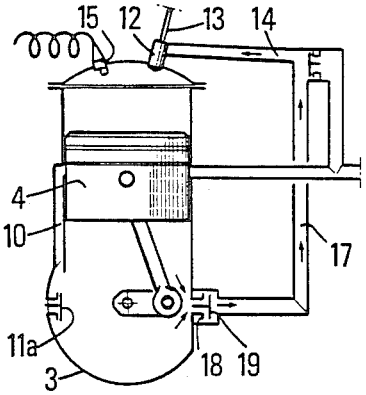
Figure 4:
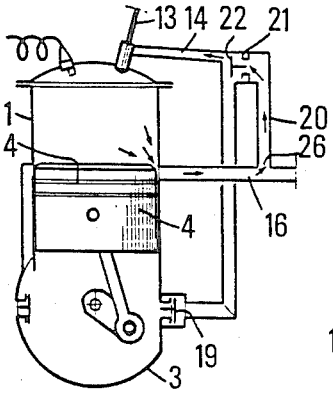
Figure 5:
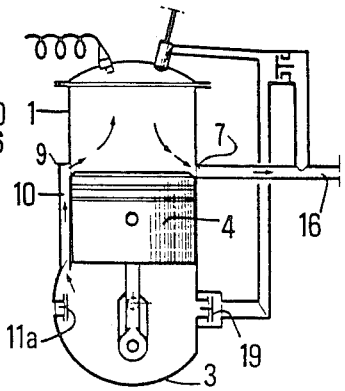

Upon a combustion initiated by the spark plug 15, the piston 4 moves away from the cylinder head 2 while compressing the air contained in crank case 3 which causes valve 11*a* to close. When the pressure is greater than the pressure existing in chamber 17, the valve 19 opens as shown in FIG. 3. The pressure in the whole of the crank case continues to rise progressively as the piston 4 moves.

When the sudden opening of the exhaust ports 7 occurs (FIG. 4), a high incident pressure wave or exhaust is formed and propagates in the exhaust pipe 16 and in tube 20. When this positive pressure wave reaches orifice 21, with the pressure in tube 20 higher than in chamber 17, the valve 22 opens and a part of the gas contained in tube 20, i.e. exhaust gas formed by a mixture of combusted gases, air and possibly fuel coming from the short circuiting, is fed into chamber 17 whose pressure is thus increased.

When the piston 4 uncovers the intake and exhaust ports 9, 7 (FIG. 5), the pressurized air contained in crank case 3 is introduced into cylinder 1 through the transfer channel 10 and intake ports 9. The pressure in the crank case 3 decreases and valve 19 closes. The pressure of the air stored in chamber 17 would then be equal to the maximum pressure reached in the entire crank case 3 if the engine were not equipped with the device of the invention.

The length of tube 20 may be calculated so that the positive exhaust pressure wave arrives at orifice 21 for filling chamber 17 after the intake ports 9 have opened, i.e. when crank case 3 has finished supplying the chamber 17 so as not to disturb or decrease this supply, this is particularly true when there is a delay between opening of the intake port 9 relatively to the opening of the exhaust ports 7. The shape of tube 20 is designed so as to promote the wave effect. That may be a tube whose curvature is regular and may also comprise sudden or progressive section changes, for example, in the form of divergent or convergent cones.

Thus, when member 12 is actuated, it is supplied with air and exhaust gas through duct 14 at maximum pressure. The time of introducing the pressurized carburetted mixture is determined by the setting of the means controlling member 12 so that there is practically no loss of carburetted mixture through the exhaust ports 7, with the supply pressure of the injector at that time being greater than that existing in the cylinder 1.

Figure 6:
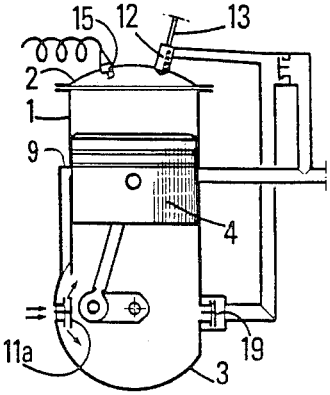

Then piston 4 moves towards the cylinder head 2 creating a compression of the carburetted mixture in cylinder 1 and a reduction of the pressure in crank case 3, whereby the valve 19 remains closed, whereas, the valve 11*a* opens permitting air penetrate or enter into the crank case 3 as shown in FIG. 6.

The above described operating steps are then reproduced in the same order.

Figure 7:
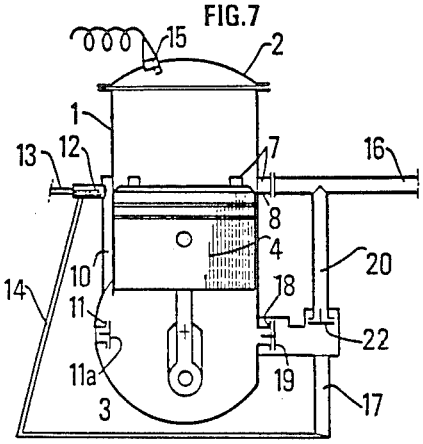
FIGS. 7, 8, 8A and 9 respectively depict alternate embodiments of the present invention.

It would still be within the scope of the invention to dispose the fuel injection member 12, fixed in the cylinder head 2 of the engine, in the transfer channel 10 so that it introduces the carburetted mixture through intake orifices as shown schematically in FIG. 7, as well as any other position on the effective volume of the cylinder.

Of course, the exact position of fuel injection member 12 to the cylinder head 2 or the transfer channel 10, or the cylinder, will be determined by the technician so that the amount of carburetted mixture which escapes through the exhaust ports 7 before combusting is zero or as small as possible.

Figure 1A:
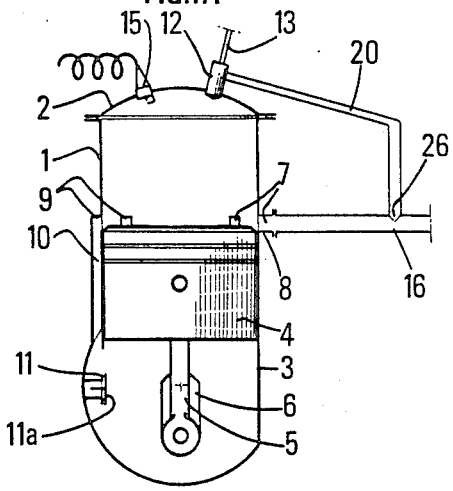
FIG. 1A is a schematic view of a first embodiment of the present invention.

More generally, the same arrangement may be used and provide sufficient pressure to provide the injection, by removing the orifice 18, the chamber 17 and the valve 19 (see FIG. 1*a*). The operation of such an arrangement is the same as the one described hereinabove with reference to 2 and 4, just by disregarding the part of the description relating to orifice 18, chamber 17 and valve 19.

Still within the scope of the invention, the invention may be applied to a four stroke engine or to a two stroke engine having pump crank cases and comprising valves.

A variant of the device of the present invention may be realized by adding to the above described engine assembly, on the tube 20, a short tube 23 opening into the free air or into an air filter through orifice 24 or into a gas source such as a source of carburetted mixture. The orifice is equipped with a valve 25 which may, for example, be a blade valve (FIG. 8).

When the positive exhaust pressure wave has reached orifice 21 and participated in sealed chamber 17, i.e. when valve 22 is closed, it may be followed, provided that an adapted configuration of the exhaust pipe is provided, by a negative pressure wave which, after passing through tube 23, reaches orifice 24 and causes valve 25 to open, with the pressure in tube 23 being then less than the atmospheric pressure of the outside air. Air is therefore introduced and drawn into the tubes 19 and 23.

It is this air instead of the escaped gases which will be then fed in the next engine cycle through the orifice 21 into the chamber 17 in accordance with the above described arrangement using the positive exhaust pressure wave caused by the sudden opening of the exhaust ports 7. More generally, the same arrangement may also be used by removing the chamber 17, the orifice 18, and the valve 19. The above-described arrangement operates in the manner described hereinabove.

Figure 8:
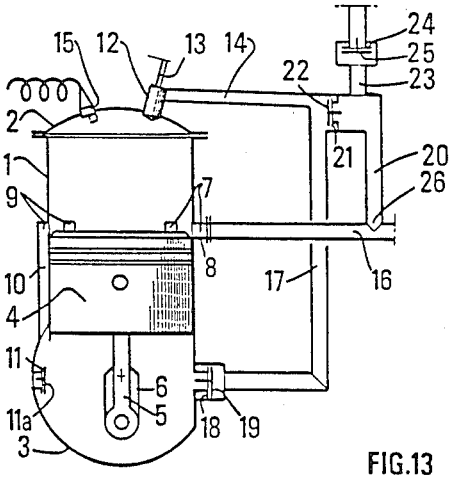
Figure 8A:
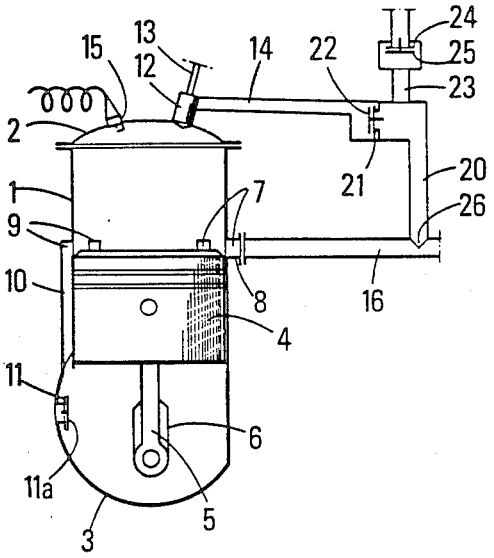

In FIGS. 1, 8 or 8A, the position of the connection 26 in either FIG. 1 whether in the case of FIG. 1 or in FIGS. 8 and 8A of tube 20 to the exhaust pipe 16 is selected so as to obtain a sufficient wave effect.

In the case of an insufficient wave effect for opening the valve 22, for the pressure in the tube 20 to reach a pressure greater than that in the sealed chamber 17, any exhaust configuration or any device may be used for artificially increasing the pressure wave effects.

Figure 9:
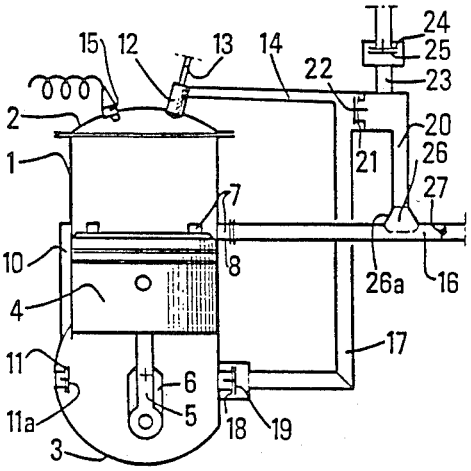

An example of such a device may be, for example, a butterfly valve 27 disposed after the connection 26 in pipe 16 (FIG. 9) whose opening angle may be corrected depending on the operating characteristics of the engine.

Another example concerning the duct configuration would be to provide a convergent form 26*a* (FIG. 9) to the tube 20 at the level of the connection 26 to the exhaust pipe, with the convergent shape having a section which decreases from the exhaust pipe 16 towards the tube 20.

Figure 12A:
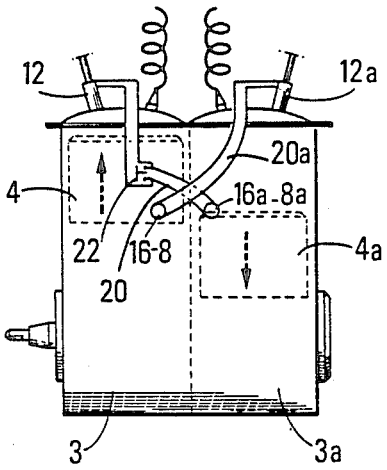
Figure 10:
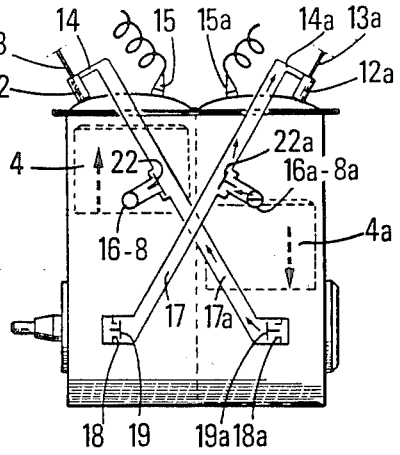
Figure 11:
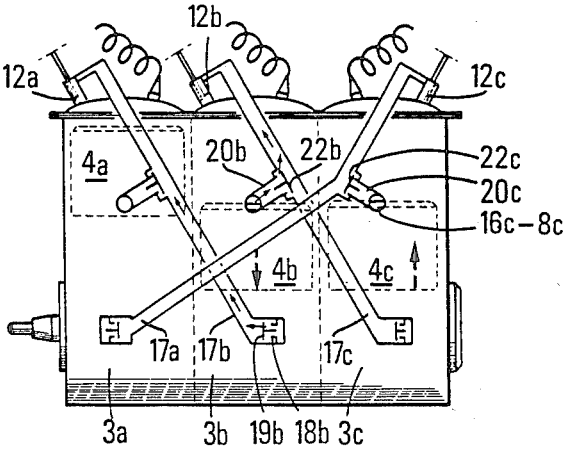
Figure 12:
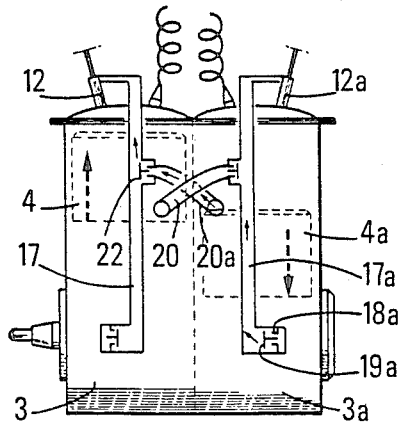

In the case of a two stroke multicylinder engine, different combinations could be contemplated, namely, a sealed chamber per cylinder, this is the case of FIGS. 10, 11 and 12, or on the contrary common to different cylinders. In the first case, the sealed chambers 17, 17*a* and 17*b* and/or 17*c* may be fed by the crank case 3, 3*a*, 3*b* and/or 3*c* of the cylinder into which they inject the air, in the case of FIGS. 12 and possibly FIG. 1 or on the contrary through the crank of case of one of the other cylinders, as in the case of FIGS. 10 and 11. Similarly, each tube 20 of the invention corresponding to the injection into a cylinder could in fact be connected through the connection communication 26 to the exhaust pipe 16 of the same cylinder as in FIGS. 10, 11 and possibly FIG. 1, as well as to that of a different cylinder, as in FIG. 12.

A particular example of application could, in the case of a multicylinder have the sealed chamber pressurized by the crank case of another cylinder and the exhaust communicating with the sealed chamber serving for injection into its own cylinder. In this case, a very short tube 20 may be sufficient for it is no longer indispensable for the positive wave to arrive after opening of the ports 7, 9. In this case the geometry of tube 20 may also be used for increasing the pressure wave effects such as for example, by a short and convergent tube 20.

FIGS. 10 and 11 show therefore such applications the two and three cylinders engines. The principle may be generalized to engines with a higher number of cylinders.

Conversely, another possibility (FIG. 12) is that each cylinder has its own sealed chamber fed by its own crank case and by a tube 20 coming from the exhaust of one of the other cylinders.

The embodiment of FIG. 12A illustrates a more general case than that of FIG. 12. According to this embodiment communications 18*a*, 19*a*, the pump crank case and the lower part of chamber 17 are no longer used but rather only a connecting pipe between the exhaust pipe 16*a* of a cylinder 3*a* and the injection member 12 of an other cylinder 12, with the connection, corresponding to the above described auxiliary duct, may or may not have a valve 22 disposed therein.

Finally, another possibility is to use a sealed chamber common to all the cylinders or only to some cylinders and fed by each crank case of the engine and by tubes 20 coming from each exhaust, this sealed chamber being connected to at least some injection members of the engine.

Figure 13:
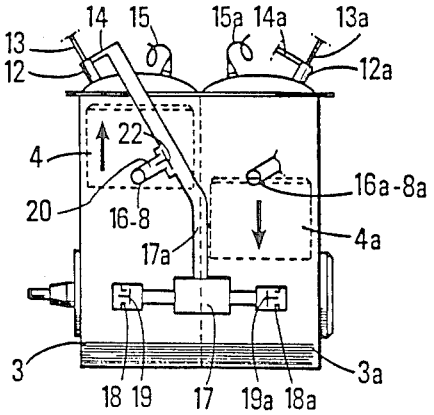
FIGS. 10, 11, 12, 12A and 13 schematically represent respective applications of the present invention to multicylinder engines.

FIG. 13 show the case of a chamber 17' connected to two different pump crank cases 3 and 3*a*, with the chamber 17' being extended by a duct 17*a'* as far as an injection member 12. Furthermore, this duct is connected to a duct 17*a'* of exhaust 16 through an auxiliary duct 20. The chamber 17' may be connected to one or more injection members 12.

What is claimed is:

1. A method for effecting an injection of fuel in an internal combustion engine, the internal combustion engine including a pneumatic injection member and an exhaust pipe, the method comprising the steps of establishing a communication between the exhaust pipe and the injection member, communicating the communication between the exhaust pipe and the injection member with a gas source via an obstruction member including one of a stop valve or a check valve.

2. A method as claimed in claim 1, applied to an engine comprising at least two cylinders, each of said cylinders comprising an exhaust pipe and an injection member, the method further comprising the steps of establishing a cross communication by connecting the exhaust pipe of one of the cylinders to the injection member of the other cylinder.

3. A method according to claim 1, wherein the step of communicating to communication between the exhaust pipe and the injection member includes providing a second stop valve or check valve for controlling the communication.

4. A method according to claim 1, wherein the internal combustion engine is a two stroke engine, further comprising the step of introducing air into a cylinder of the internal combustion engine through a transfer means communicating with a sealed crank case of the engine.

* * * * *